US005384969A

United States Patent [19]

Troetscher et al.

[11] Patent Number: 5,384,969

[45] Date of Patent: Jan. 31, 1995

[54] APPARATUS FOR DRYING BULK MATERIAL WITH A FILTER FOR A DRYING GAS FLOWING THROUGH THE BULK MATERIAL

[75] Inventors: Gerhard Troetscher; Anton Hecht, Lindau, both of Germany

[73] Assignee: Lindauer Dornier Gesellschaft mbH, Lindau, Germany

[21] Appl. No.: 73,174

[22] Filed: Jun. 8, 1993

[30] Foreign Application Priority Data

Jun. 9, 1992 [DE] Germany ..... 4218699

[51] Int. Cl.[6] ..... F26B 3/02

[52] U.S. Cl. ..... 34/82; 34/236; 34/629

[58] Field of Search ..... 34/10, 79, 82, 85, 217, 34/236

[56] References Cited

U.S. PATENT DOCUMENTS

| | | | |
|---|---|---|---|
| 2,597,490 | 5/1952 | Hurxthal | 34/82 |
| 4,435,909 | 3/1984 | Williamson, Jr. | 34/82 |
| 4,615,124 | 10/1986 | Gierse et al. | 34/155 |
| 4,949,472 | 8/1990 | Arnone | 34/236 |
| 4,949,474 | 8/1990 | Berg | 34/236 |

*Primary Examiner*—Henry C. Yuen

*Attorney, Agent, or Firm*—W. G. Fasse; W. F. Fasse

[57] ABSTRACT

A bulk material dryer of the through flow type is equipped with an air permeable bulk material conveyor for carrying the bulk material through a dryer housing. The inlet and outlet ends of the dryer housing are sealed by paddle wheels, the paddles of which dip into the layer of bulk material on the bulk material conveyor. A moving filter belt is arranged in the dryer housing in such a position that dust laden air that has passed through the bulk material must also pass through the moving filter belt for the continuous cleaning of the drying air. One or more cleaning devices are arranged along the moving filter belt for in turn cleaning the filter belt, thereby assuring a continuous drying operation.

20 Claims, 2 Drawing Sheets

APPARATUS FOR DRYING BULK MATERIAL WITH A FILTER FOR A DRYING GAS FLOWING THROUGH THE BULK MATERIAL

FIELD OF THE INVENTION

The invention relates to an apparatus for drying bulk material, such as sludge, granular material, and the like permeable to the through flow of air. The bulk material passes on a conveyor through a dryer housing for a continuous drying operation.

BACKGROUND INFORMATION

Dryers of this type are also referred to as through flow dryers for drying sludge of all types and other bulk materials. The bulk material is transported continuously through a dryer housing on a bulk material conveyor. The conveyor inlet and the conveyor outlet of the housing are sealed to reduce the escape of a hot drying gas, usually air. The dryer housing is provided with compression chambers into which the drying air is introduced for passing through the bulk material to be dried. Suction chambers are arranged to collect the air that has passed through the bulk material and through the conveyor that transports the bulk material through the dryer housing. Most of the air from the suction chambers is returned into the circulatory flow of the drying air so that the same hot air is repeatedly used for the drying operation.

Conventional devices of this type generate a substantial quantity of dust which is an undesirable side effect of the drying operation. Such dust has a tendency to be deposited in the above mentioned suction chambers as well as in the compression chambers in all those locations where the air flow is minimal, or where there is a dead air space tending to accummulate dust, whereby the compression and suction chambers are contaminated. Similarly, the air circulating fan or ventilator is exposed to this dust so that frequent cleaning operations are unavoidable. An additional danger exists due to possible dust explosions.

Thus, efforts have been made to clean the repeatedly used drying air, for example, by passing the drying air through a cyclone particle separator, wherein most of the dust is separated before the air is returned into the drying cycle. It is also known to pass the drying air through a stationary filter. Both conventional drying air cleaning operations, either by a cyclone separator or by a stationary filter, have the disadvantage that the efficiency of the separation is unsatisfactory. Besides, a cyclone separator of sufficient capacity for large scale operations is quite involved and correspondingly expensive.

OBJECTS OF THE INVENTION

In view of the foregoing it is the aim of the invention to achieve the following objects singly or in combination:

- to construct a cleaning mechanism for the drying air as part of the drying apparatus in such a manner that a high efficiency cleaning of the drying air is achieved while the production and maintenance costs are reduced or at least kept at an economically feasible level;
- to pass the drying air through a moving filter that is easily accessible to a filter cleaning operation in a continuous manner;

- to arrange the moving filter so that cleaning of the drying air takes place prior to its return to the fan or ventilator but after its passage through the bulk material;
- to clean the drying air filter by a separate air flow that is not returned to the fan that moves the drying air, whereby the filter cleaning air does not need to be heated;
- to assure an automatic cleaning of the moving filter so that the drying operation can be performed continuously.

SUMMARY OF THE INVENTION

The above objects have been achieved according to the invention in a drying apparatus in which a conveyor forms or moves a drying gas filter in such a way along the bulk material transport conveyor, that the drying air that has passed through the bulk material must now pass through the travelling filter before the air returns to the fan that circulates the hot drying air. Preferably, the travelling filter is carried by or part of an endless conveyor belt that travels along a suction chamber into which the drying air is sucked from a compression chamber through the bulk material being dried. At least one, preferably several, cleaning units are arranged along the travel path of the conveyor filter belt for automatically cleaning the conveyor filter for a continuous operation.

According to a preferred embodiment the filter conveyor runs in parallel to the bulk material conveyor and below the bulk material conveyor through the suction chamber below the bulk material conveyor, whereby the drying air must first pass through the bulk material and through the air permeable bulk material conveyor belt into the suction chamber and through the filter conveyor. The filter conveyor belt is driven in various ways. In a preferred embodiment the filter conveyor belt is driven with a constant or continuous speed which is approximately the same as the speed of the bulk material conveyor belt. The filter belt may run either in the direction of the conveyor belt or in a direction opposite to that of the movement direction of the conveyor belt. It is also possible to sequentially change the movement direction of the filter belt to move partly in the direction of the conveyor belt or opposite thereto, whereby the filter belt speed may either be constant or variable in either direction. The selection of the movement direction and speed for the filter belt will depend on the type of dust collected and on the most efficient cleaning operation for any particular type of dust or bulk material.

Passing the dust laden drying air through the filter conveyor belt by suction is preferred since it appears to provide a very efficient cleaning. However, passing the dust laden drying air through the filter conveyor belt by compression may also be practiced.

According to the invention various methods may be employed to clean the filter conveyor belt automatically and while the belt is moving through a filter cleaning device. In a preferred embodiment the filter cleaning device has its own filter cleaning air stream which is caused to pass through the filter in a direction opposite to the direction of the drying air flow through the filter, whereby a blowing chamber or box is placed below the filter belt and a suction chamber or box is placed above the filter belt. Several such cleaning devices may be spaced from one another along the travel path of the filter belt. The blowing chamber or box is so arranged that it directs a cleaning air stream approximately perpendicularly to the plane of the filter belt, while the suction chamber or box is arranged above the filter belt to receive the dust laden air that has passed through the filter belt. The dust so removed from the filter belt is collected in the suction box or outside the suction box, for example in a vacuum cleaner type bag or the air that has passed through the pores or meshes in the filter belt is otherwise cleaned conventionally and preferably returned into the cleaning air flow. Preferably, the inlet or intake side of the suction box of the cleaning device does not extend in parallel to the plane of the filter belt. Rather, the intake side extends at a slant so that the filter dust on the filter belt runs into a suction gap that tapers conically in the direction of the filter belt movement. Thus, a surface layer of dust collected to a certain thickness on the filter belt will initially be sucked into the suction chamber as the dust on the filter belt enters into the cleaning device. In other words, this slanted opening of the suction box above the filter belt contributes to gradually removing the dust from the filter layer by layer so to speak, so that the last dust layer next to the surface of the filter belt is removed from the belt in the conically narrow zone of the suction chamber, whereby a highly efficient suction removal takes place because the flow speed of the cleaning air increases as the suction gap narrows in the belt travel direction.

The filter belt may be constructed of a synthetic screen belt material having the desired mesh opening, whereby the mesh will be selected in accordance with the type of dust to be collected. Fine dusts will be collected by a filter fleece which may be made of paper, synthetic materials, textile materials, or the like. It has been found that an efficient cleaning of the filter belt is accomplished even if only a suction box is arranged next to the belt without a blowing box next to the belt. This is possible since the suction box for cleaning the filter belt may take the air directly from the suction chamber through which the drying air passes. However, this practice may not be desirable in certain instances, because it requires an extra drying air supply that needs to be heated while the cleaning air as such does not necessarily have to be heated. Thus, it is preferable to provide each cleaning device with its suction box on one side of the filter belt and with its blowing box on the opposite side of the filter belt, and passing a separate unheated cleaning air stream through the filter belt.

It is also within the present teaching to use other cleaning devices for cleaning the filter belt, for example, by directing a pressurized air onto the dust layer on the filter belt or by providing a brush cleaning operation or even a high pressure water jet cleaning. In all these instances the removed dust must be collected by conventional devices. All the just mentioned cleaning possibilities have the advantage that the filter belt is automatically cleaned so that a continuous drying operation can be performed and separate standstill cleaning operations, such as are necessary where stationary filters are used, are avoided.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND 0F THE BEST MODE OF THE INVENTION

Figure 1:
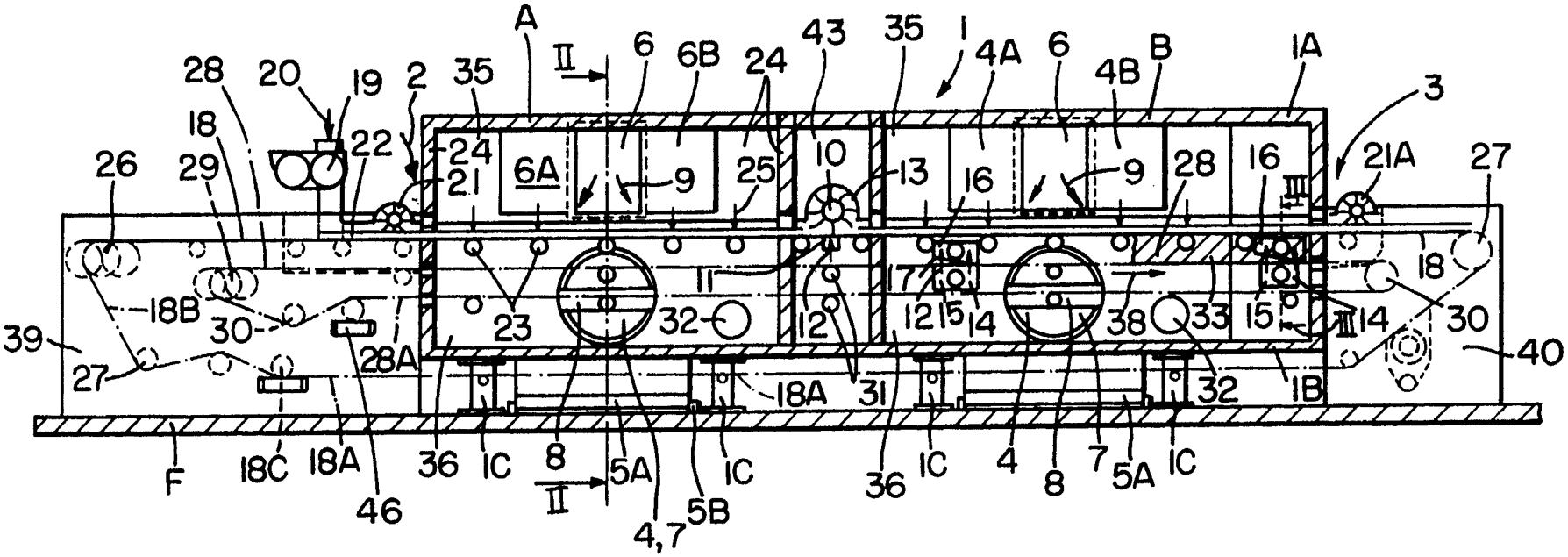
FIG. 1 is a side sectional view through the present apparatus, wherein a bulk material carrying run of a bulk material conveyor and an upper run of a filter belt conveyor move from left to right.
Figure 2:
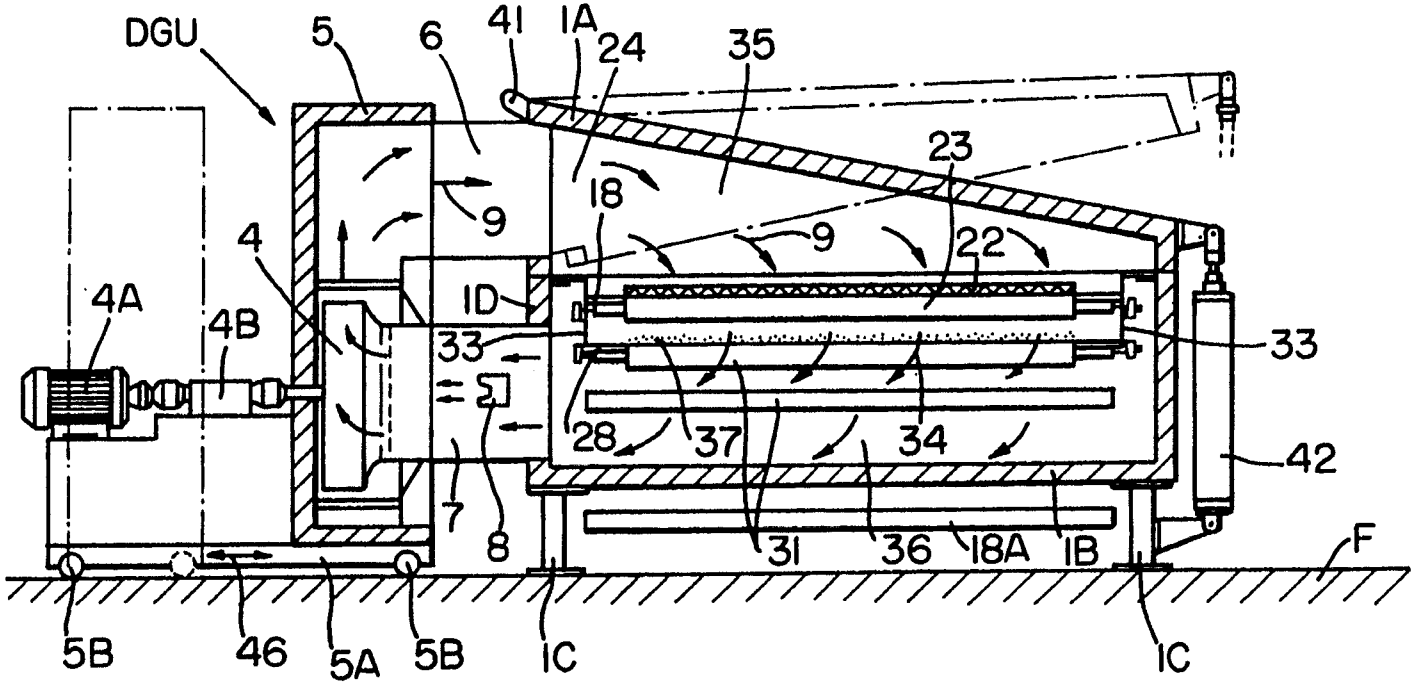
FIG. 2 is a sectional view in the section plane II—II in FIG. 1 to show a drying gas supply unit.

FIG. 1 shows a through flow dryer 1 having a housing with a top section 1A forming a cover as best seen in FIG. 2, and a bottom section 1B mounted on supports 1C to rest on a floor F. The housing of the dryer 1 is, e.g. divided into two dryer sections or zones A and B which are interconnected with each other as will be described below. The dryer zone housing section A has an inlet 2 for an upper run 18 of an endless bulk conveyor belt 18B also having a lower or return run 18A. The inlet 2 is substantially hermetically sealed by a paddle wheel 21 in a respective housing.

The second housing section B has an outlet 3 for the upper run 18 of the bulk conveyor to discharge dried bulk material 22 into a collecting container 40. The outlet 3 is also substantially hermetically sealed by a further paddle wheel device 21A in its respective housing. The walls of the housing sections A and B are preferably heat insulated. The lower or return run 18A of the conveyor 18B passes outside of the housing as best seen in FIG. 1.

FIG. 1 shows only two dryer housing zones A and B and each of these zones is of identical construction. Thus, description of one zone is sufficient. More than two zones may be arranged In series. At least one, preferably each drying zone has a filter cleaning device.

Each dryer housing section or zone A, B, . . . cooperates with at least one drying gas supply unit DGU as best seen in FIG. 2. Each drying gas unit includes a fan 4 in a fan housing 5 for mounting the fan 4 with its drive motor 4A and a coupling gear 4B. Preferably, the drying gas unit DGU is mounted on a carriage 5A having wheels 5B as best seen in FIG. 2. The drying gas unit has a blower outlet 6 with drying gas distributing ducts 6A and 6B. Further, the fan 4 has a suction inlet port 7 including a heater 8. The blower duct 6 and the suction port or duct 7 are releasably flanged to the side wall 1D of the respective housing zone. The side wall is provided with respective openings as best seen in FIG. 2, whereby the drying gas unit DGU can be easily removed on its carriage 5A from the drying housing to facilitate easy access to both the drying housing and the drying gas unit. Normally air is used as the drying gas.

The fan 4 produces pressurized hot air that passes through the blower duct 6 and the air distribution ducts 6A and 6B into a pressure chamber 35 enclosed by housing wall sections 24. The pressure chamber 35 has downwardly open blowing holes 25 through which hot drying air 9 passes onto and through moist bulk material 22 on the upper run 18 of the conveyor 18B made of mesh material.

The endless bulk material conveyor belt 18B with its runs 18 and 18A is mounted at its inlet end on a tensioning roller 26 that is adjustable in its position as indicated by the several dashed line roller positions. The discharge end of the conveyor runs around a guide roller 27 and a plurality of support rollers 23 are arranged so that the upper run 18 may pass along the support rollers 23. As shown in FIG. 2, lateral walls 33 are so positioned that the pressure chamber 35 is closed off from a suction chamber 36 arranged in the dryer housing below the upper conveyor run. A conveyor belt drive 18C drives the bulk conveyor belt 18B so that its upper run moves from left to right in FIG. 1. The bulk conveyor 18B is permeable to the drying air.

According to the invention an endless conveyor filter belt with an upper run 28 and a lower run 28A is arranged to pass through the suction chamber 36 of the respective dryer housing section below the upper run 18 of the endless bulk conveyor 18B. The endless filter belt collects with its upper run 28 the dust that is generated by the drying of the bulk material 22. The dust is shown at 37 in FIG. 2. Referring to FIG. 2, the dust laden air 34 passes through the upper run 28 of the filter belt, whereby the drying air is cleaned and returned through the suction port 7 past the heater 8 to the fan 4. The just described endless filter belt 28 is so positioned that the air must pass first through the bulk material and then through the filter for intercepting dust 37 in the drying gas directly after the drying gas has passed through the bulk material. The dust 37 collected on endless the filter belt 28 is transported to a filter cleaning device 44 for automatically cleaning the moving endless filter belt, thereby assuring a substantially continuous operation of the present apparatus. The cleaning device will be described in more detail below.

The moist bulk material 20 to be dried, such as sludge, is passed through a feeder device 19, such as a double screw conveyor 19, whereby the bulk material is applied to the upper run 18 of the conveyor 18B to a certain depth for passing into the dryer housing through the paddle wheel 21 which assures a continuous substantially hermetical seal at the inlet 2 because the paddles of the wheel 21 enter into the bulk material 22 on the conveyor run 18.

Figure 3:
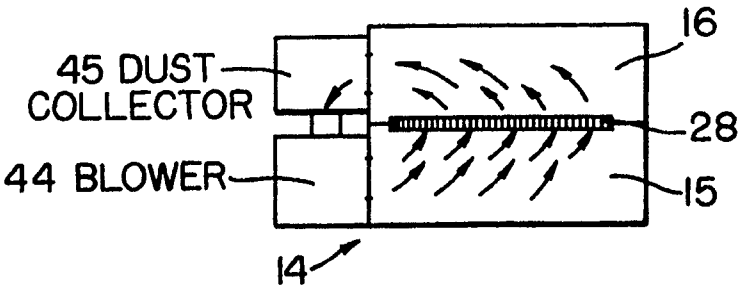
FIG. 3 is a sectional view along section plane III—III in FIG. 1 to show a filter cleaning device.

As shown in FIGS. 1 and 3 in a preferred embodiment of the invention two neighboring drying zones A and B are spaced from one another in the same housing by a spacer chamber 43. A bulk material turnover wheel 10 is positioned in the spacer chamber 43 in such a position that its turnover prongs or arms contact the bulk material 22 on the upper run 18 of the bulk conveyor that travels through the spacing chamber 43. Preferably, the turnover wheel 10 is mounted in a housing 13 that forms a suction channel. Additionally, an air blowing channel 11 is positioned below the upper run 18 of the bulk conveyor to pass additional air through the bulk material as it is being turned over. The additional air is then drawn into the suction channel 13. The filter conveyor belt with its upper run 28 and its lower run 28A also passes through the spacer chamber 43, preferably over support rollers 31. The turnover wheel D rotates so that its downwardly facing arms that contact the bulk material move in a direction opposite to the travel direction of the upper run 18 of the bulk conveyor. Thus, in FIG. 1 the arms of the wheel 10 that momentarily face down move from right to left while the upper run moves from left to right. The material carried by the arms of the turnover wheel 10 is then again deposited on the upper run 18. The air from the blowing channel 11 is blown in the direction of the arrow 12 upwardly through the upper run 18 of the bulk conveyor. The air 12 passing through the bulk conveyor is sucked off and may be separately cleaned.

Referring to FIGS. 1 and 3, two cleaning devices 14 are provided for cleaning the endless filter belt 28. One cleaning device 14 is positioned downstream of the turnover wheel 10, the other cleaning device 14 is positioned downstream of the second blowing unit close to the exit end 3. These cleaning devices automatically remove dust collected on the endless filter belt 28, thereby assuring a substantially continuous operation of the present drying apparatus. FIG. 3 shows a sectional view along section plane III—III in FIG. 1, illustrating that each cleaning device 14 comprises a lower blowing box 15 and an upper suction box 16. The upper run 28 of the endless conveyor filter belt travels through a gap between these two boxes. A blower 44 blows cleaning air into the blower box 15 and dirty air passing through the suction box 16 is collected in a dust collector 45 such as a filter bag or the like. The dust collector 45 and the blower 44 are preferably located outside the dryer housing. As shown in FIG. 1, the conveyor filter belt extends through the entire dryer housing. However, it is also possible to arrange filter belts only where the dust collection is most necessary.

The filter belt 28 is cleaned by removal of the dust 37 by the above described cleaning air flow which is separate of the drying air flow. As shown in FIG. 1, the blowing box 15 and the suction box 16 are preferably both arranged inside suction chamber 36 of the dryer housing. The cleaning air stream through the boxes 15 and 16 is separate from the drying air stream.

As seen in FIG. 1, the downwardly facing suction intake surface of the suction box 16 is slanted so that the upstream end of the gap is larger than the downstream end of the gap as viewed in the movement direction 38 of the upper run 28 of the filter belt. This construction of the suction box with a slanted bottom facing the belt first collects an upper dust layer on the belt and then gradually collects down to the belt surface on the right-hand end of the gap as viewed in FIG. 1. Thus, the belt is gradually, but efficiently cleaned since the suction increases as the gap narrows, resulting in an optimal cleaning of the filter belt run 28.

The size and location of the cleaning devices 14 will depend on the particular type of dryer and on the type of bulk material being dried. In other words, the quantity of filter dust 37 collected by the belt 28 will be taken into account when dimensioning and positioning the blower box 15 and the suction box 16 along the belt in the travel direction 38. It is not necessary that each drying zone A, B has a cleaning device for some bulk materials.

Generally, one or two cleaning devices will be sufficient for the intended purpose.

Incidentally, the conveyor filter belt 28, 28A runs around a tensioning roller 29 and around a guide roller or rollers 30. A separate drive mechanism 46 drives the conveyor filter belt 28, 28A independently of the operation of the bulk conveyor 18, however in the manner described above. Support rollers 31 are preferably provided for the filter belt centrally between its ends as shown in the spacing chamber 43 of FIG. 1.

Referring to FIG. 1, it should be noted that the ports 32 shown in FIG. 1 lead into venting ducts through which moist air is removed from the drying housing by a central exhaust ventilator not shown, but connected through these venting ducts 32 to the suction chambers 36.

As described above, the heated drying gas, usually air 9, passes first through the conveyor belt upper run 18 and then through the filter belt upper run 28. However, the cleaning air blown by the blower 45 into the blower box 15 of the cleaning device 14 flows through the filter belt in a direction opposite to that of the drying gas for an efficient cleaning of the filter belt. Further, it is also possible to clean the lower run 28A of the filter belt rather than its upper run. For this purpose the cleaning devices would be merely repositioned within the dryer housing for cooperation with the lower filter belt run 28A, whereby gravity may even enhance the cleaning effect.

Referring further to FIG. 2, the housing cover 1A is hinged at 41 so that the housing can be opened by tilting the cover 1A into the dash-dotted position, for example, with the aid of a power drive such as a piston cylinder device 42. In the closed position the cover 1A slants from left to right so that the incoming air from the blower duct 6 is diverted and accelerated onto the bulk material 22 to be dried on the conveyor run 18. This slant of the cover 1A assures a uniform distribution of the drying air into the bulk material 22. FIG. 2 further shows that the carriage 5A is movable back and forth as indicated by the double arrow 46 in order to facilitate separation of the drying gas unit DGU from the dryer housing 1A, 1B, and to again connect the two units after maintenance work or the like.

Although the invention has been described with reference to specific example embodiments, it will be appreciated that it is intended to cover all modifications and equivalents within the scope of the appended claims.

What we claim is:

1. An apparatus for drying bulk materials, comprising at least one drying unit including a sealed dryer housing having an inlet for moist bulk material and an outlet for dried bulk material, and at least one drying gas supply unit for each drying unit, said drying gas supply unit including a fan for circulating drying gas through said bulk material, drive means for said fan and a fan housing for mounting said fan and its drive means, said apparatus further comprising in said dryer housing bulk material endless conveyor means including an air permeable endless bulk conveyor belt having an upper run for transporting bulk material through said dryer housing from said inlet to said outlet, and a lower return run, at least one endless moving filter conveyor for removing dust from said drying gas, said endless moving filter conveyor being positioned in said dryer housing in parallel to and below said upper run of said endless bulk conveyor belt for intercepting dust in said drying gas directly after said drying gas has passed from above downwardly through said bulk material on said upper run of said endless bulk conveyor belt, and at least one filter conveyor cleaning device arranged for cleaning said endless moving filter conveyor with a cleaning gas flow from below upwardly through said filter conveyor for a continuous bulk material drying operation.

2. The apparatus of claim 1, wherein said dryer housing comprises at least one suction chamber (36) and at least one blowing chamber (35), said endless bulk material conveyor means comprising an endless bulk conveyor belt having said upper run passing between said suction chamber and said blowing chamber, said endless moving filter conveyor comprising an endless conveyor filter belt passing through said suction chamber (36).

3. The apparatus of claim 2, wherein said suction chamber (36) is arranged in said dryer housing below said upper run of said bulk conveyor belt, and wherein said blowing chamber is arranged in said dryer housing above said upper run of said bulk conveyor belt so that said endless filter belt conveyor is arranged in said suction chamber below said bulk conveyor belt.

4. The apparatus of claim 1, wherein said endless moving filter conveyor comprise an endless filter belt extending longitudinally entirely through said dryer housing.

5. The apparatus of claim 1, wherein said endless moving filter conveyor comprise an endless filter belt shorter than said dryer housing so that said endless filter belt extends entirely in said dryer housing.

6. The apparatus of claim 1, wherein said endless moving filter conveyor comprise an endless conveyor filter belt and drive means for moving said endless conveyor filter belt in a feed advance direction of said endless bulk material conveyor means.

7. The apparatus of claim 6, wherein said drive means move said endless conveyor filter belt with a constant feed advance speed in said feed advance direction.

8. The apparatus of claim 6, wherein said drive means move said endless conveyor filter belt intermittently in said feed advance direction of said bulk material conveyor means.

9. The apparatus of claim 1, wherein said endless moving filter conveyor comprises an endless conveyor filter belt and drive means for moving said endless conveyor filter belt in a direction opposite to a feed advance direction of said endless bulk material conveyor means.

10. The apparatus of claim 9, wherein said drive means move said endless conveyor filter belt with an intermittent feed advance speed in said opposite direction.

11. The apparatus of claim 9, wherein said drive means move said endless conveyor filter belt with a constant feed advance speed in said opposite direction.

12. The apparatus of claim 1, wherein said endless moving filter conveyor comprises an endless conveyor filter belt, and wherein said cleaning device comprises a suction box (16) on one side of said endless conveyor filter belt, and a blower box (15) on an opposite side of said endless conveyor filter belt, whereby cleaning air from said blower box passes through said endless conveyor filter belt for collection by said suction box.

13. The apparatus of claim 12, wherein said blower box (15) has a blower surface extending substantially in parallel to said endless conveyor filter belt, and wherein said suction box (16) has a suction surface (17) that slants at an angle toward said endless conveyor filter belt (28) in a transport direction of said conveyor filter belt, whereby a downstream end of said suction surface is closer to said endless conveyor filter belt than an upstream end of said suction surface.

14. The apparatus of claim 12, wherein said cleaning device further comprises a blower for transporting cleaning air through said blower box (15), through said endless conveyor filter belt, and through said suction box, whereby said cleaning air forms a flow which is independent of any flow of said drying gas.

15. The apparatus of claim 1, further comprising in said dryer housing a turnover device positioned above said endless bulk conveyor belt for turning over bulk material on said upper run of said endless bulk conveyor belt.

16. The apparatus of claim 15, wherein said dryer housing has a plurality of drying zones, and wherein said turnover device is arranged between two neighboring drying zones.

17. The apparatus of claim 1, wherein said dryer housing has a lower section (1B) and a cover (1A), hinge means (41) securing said cover to said lower section, and drive means (42) for opening and closing said cover section (1A).

18. The apparatus of claim 17, wherein said cover has a slanted roof that is inclined crosswise and toward said endless bulk conveyor belt for accelerating and diverting said drying gas toward said endless bulk conveyor belt when said cover is closed.

19. The apparatus of claim 1, wherein said drying gas supply unit comprises a carriage on which said fan housing, said fan, and said fan drive means are mounted to form said drying gas supply unit as a unit separate from said dryer housing, said fan housing having a suction inlet port and a blower outlet port, said dryer housing having a suction outlet port for coupling to said suction inlet port of said fan housing, said dryer housing having a blower inlet port for coupling to said blower outlet port of said fan housing, and wherein said carriage comprises wheels for moving said separate drying gas supply unit into cooperation with any one of a plurality of said dryer units.

20. The apparatus of claim 12, wherein said cleaning air from said blower box passes through said endless conveyor filter belt in a direction opposite to a flow direction of said drying gas passing through said endless conveyor filter belt.

* * * * *